United States Patent [19]

Vexler et al.

[11] Patent Number: 4,745,002

[45] Date of Patent: May 17, 1988

[54] ELECTRICAL CONDUCTORS FOR CABLE

[75] Inventors: Gavriel L. Vexler, Montreal West; B. Paul S. Cheema, Dollard-Des-Ormeaux, both of Canada

[73] Assignee: Northern Telecom Limited, Montreal, Canada

[21] Appl. No.: 802,412

[22] Filed: Nov. 27, 1985

[51] Int. Cl.[4] ..... B05D 3/06; B05D 1/24

[52] U.S. Cl. ..... 427/52; 72/274; 427/120; 427/175; 427/185; 427/195; 427/328; 427/346; 427/357

[58] Field of Search ..... 427/120, 185, 52, 192, 427/357, 427, 175, 328, 346; 72/274

[56] References Cited

U.S. PATENT DOCUMENTS

| | | | |
|---|---|---|---|
| 1,163,342 | 12/1915 | Hurley et al. | 427/120 |
| 1,244,414 | 10/1917 | Bernheim et al. | 427/192 |
| 4,102,678 | 7/1978 | Gothard et al. | 427/192 |
| 4,170,494 | 10/1979 | Fujii et al. | 427/185 |
| 4,224,090 | 9/1980 | Garner | 427/185 |
| 4,252,583 | 2/1981 | Garner | 427/120 |
| 4,265,686 | 5/1981 | Garner | 427/120 |
| 4,333,419 | 6/1982 | Hufnagl | 427/192 |

*Primary Examiner*—Janyce A. Bell

*Attorney, Agent, or Firm*—R. J. Austin

[57] ABSTRACT

Method of making copper clad conductor by impinging of copper particles upon a heated steel wire to cause adhesion of the particles to the wire, by coalescence, building up the particles to form a coating and then drawing the coated wire to the required diameter. The coated wire may be heat treated to cause flow of copper to improve the surface finish before the drawing process. The copper particles may be directed at the wire by a spraying technique. Alternatively, the wire is passed over a fluidized bed of the particles and through a cloud of particles thrown up by the bed.

10 Claims, 1 Drawing Sheet

ELECTRICAL CONDUCTORS FOR CABLE

This invention relates to electrical conductors for cable.

Electrical conductors are normally formed from copper which has been drawn down to the desired diameter. In another construction however, electrical conductors comprise a steel inner member which is surrounded by a copper cladding. The normal method of forming such a conductor is to commence with a cylindrical steel billet and deposit a copper layer around it by a casting operation. The composite steel and copper construction is then drawn down to its desired diameter and to produce an increased length which is suitable for commercial manufacture of cable.

While the copper clad construction is formed because it is considered to be cheaper than purely copper conductor, nevertheless the provision of a billet, the casting operation and the lengthy drawing down procedure is inordinately expensive.

The present invention provides a process for producing a copper clad steel conductor construction which is more economic.

According to one aspect of the present invention there is provided a method of making a copper clad conductor comprising causing copper particles to impinge upon a surface of a steel wire, while preferentially heating said surface to a temperature above the melting point of copper to effect adhesion of the particles to the wire, building up the particles to produce a coating of copper by coalescense of the particles, heating the outer layer of copper coating upon the wire to improve the smoothness of the surface finish and then drawing.

According to another aspect of the present invention, there is provided a method of making a copper clad conductor construction comprising causing copper particles to impinge upon the surface of a steel wire while causing a current to flow at said surface to preferentially heat said surface to a temperature above the melting point of copper and thereby effect adhesion of the particles to the wire, building up the particles to produce a coating of copper by coalescence of the particles, and then drawing the copper coated steel wire to the required diameter.

By the process according to the invention, the procedure followed to produce the copper coated steel wire is shorter than the known process using a steel billet. Also, the inventive process is energy efficient, because the copper is formed into a layer by a simple and rapid process and the steel wire requires less drawing to obtain the copper coated conductor of the required diameter than is the case in the conventional procedure commencing with a steel billet. As a result and partly because of the avoidance of the use of the steel billet and the casting operation, a more economically produced copper clad conductor is provided.

Surface smoothness is improved before drawing by preferably heat treating the copper coated wire to cause a flow of the copper upon the steel. This heat treatment is conveniently provided by an induction heating process.

The copper particles may be applied by spraying them preferably from orifices arranged around the steel wire and also preferably by using an airless spray technique. Alternatively, the particles are applied by subjecting the steel wire to the effects of a fluidized bed of the particles. Conveniently the wire may be passed over the bed so as to move through a cloud of the particles thrown up from the bed. While passage of the wire through the bed is a possibility, care should be taken to avoid sufficient heat loss from the steel wire into the fluidized bed to prevent adherence of the particles to the wire. Minimizing heat loss is made possible preferably by employing high frequency vibration means for fluidizing the bed.

Heating of the steel wire before contact by the copper particles is performed in a practical method by inducing current at a high frequency, e.g. 10 MHz, in the wire thus heating a very thin layer on the surface of the wire due to the so-called "skin effect".

On a practical basis, it is preferred that the particles should have substantially flat surfaces to assist in their adherence to the wire. For this purpose, they may be of substantially planar shapes of, for instance, 2 to 20 microns thickness and may be substantially square in plan view with perhaps, each side measuring between 20 and 100 microns.

One embodiment of the invention will now be described by way of example with reference to the accompanying drawings in which.

Figure 1:
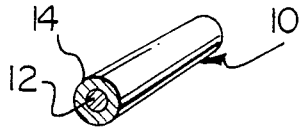
FIG. 1 is an isometric view on large scale of part of a copper clad conductor.

As shown by FIG. 1, a copper clad conductor 10 is between 19 and 26 AWG and comprises a steel core 12 surrounded by a thin copper cladding 14.

Figure 2:
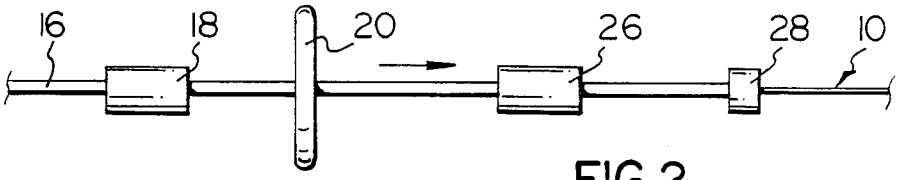
FIG. 2 is a side elevational and diagrammatic view on smaller scale than FIG. 1 of one apparatus for coating steel wire with copper and for producing the conductor shown in FIG. 1.
Figure 3:
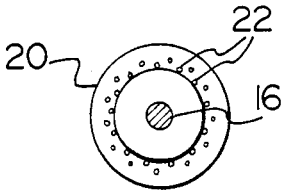
FIG. 3 is a cross-sectional view of the apparatus taken along line III—III in FIG. 2.
Figure 4:
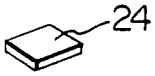
FIG. 4 is a magnified isometric view of a copper particle.

The copper clad conductor may be made in the apparatus shown in FIGS. 2 and 3. As shown by FIG. 2, a steel wire 16, of larger diameter than the finished diameter of the steel core 12, is passed through an induction furnace 18 operating at about 10 MHz. By the phenomenon known as "skin effect", the wire has a thin surface layer (i.e. less than 1 ml thickness) heated to a temperature between 2000° F. and 2200° F. (which exceeds 1981.4° F., the melting point of copper). The steel wire at that surface temperature is then passed directly through a means for spraying the surface of the wire with copper powder or particles. In this particular embodiment, this means is in the form of an airless spray device 20. Airless spray devices and their means of operation are known. Description of the device 20 need not be given, therefore, except to indicate that, as shown by FIG. 3, the airless spray device 20 comprises an annular tube surrounding the feedpath for the wire 16 and the tube is formed with orifices 22 at its inner surface for directing powder particles towards the heated steel wire as it passes through the device. As the wire passes through the device, the powder particles not only soften and adhere to the steel wire upon contact with it but also the particles coalesce on the wire surface so as to form a continuous surrounding coating on the wire. To assist in the adherence of the copper to the steel, it is preferred to have the copper particles of a certain shape and also of certain size. For instance, the particles will adhere more positively if they have flat surfaces for contacting the wire instead of convex surfaces which will occur if the particles are in the form of spheres. In one suggested construction, the particles 24 are planar, such as is shown in FIG. 4, and have a thickness of between 2 and 20 microns. The particles may, for instance, be rectangular or square. In the latter case the measurement along the side of the square may perhaps be between 20 and 100 microns.

The process therefore envisages the passage of the heated steel wire through the device 20 at such a speed that the particles cover the steel wire completely and also to a controlled thickness to enable the copper layer 14 to have a predetermined thickness upon the completed copper clad conductor 10.

After passage through the device 20, the copper clad steel wire 16 is heat treated to help improve surface smoothness of the copper. One way of providing this heat treatment is to pass the copper clad steel wire through an induction furnace 26 to provide sufficient heat at the right frequency to soften the copper for less than 0.001 inch thickness and cause it to flow to improve the surface smoothness. Upon leaving the induction furnace, the copper clad steel wire is then passed through a drawing die 28 in which it is drawn down to the required finished diameter thus resulting in the copper clad conductor 10.

It will be appreciated from the above embodiment, that the procedure according to the invention commences with a steel wire 16 which need not be substantially greater in diameter than the finished diameter of the steel core 12. Thus the drawing operation to reduce the copper coated steel wire to the final diameter is not itself a substantially time consuming or expensive operation. However, this procedure avoids the necessity of forming a copper clad steel billet in the conventional fashion and reducing it by a lengthy and expensive process to the required conductor diameter.

Figure 5:
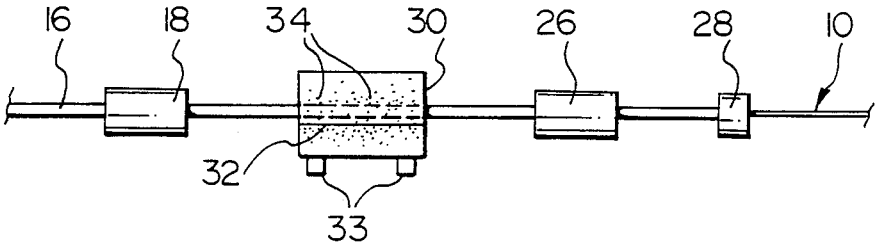
FIG. 5 is a view similar to FIG. 2 of a second apparatus for coating steel wire with copper and for producing the conductor.

The conductor 10 may be made, alternatively, in the apparatus shown by FIG. 5. This apparatus, which is otherwise similar to that shown in FIG. 2, uses a fluidizable bed apparatus 30 instead of the airless spray device 20.

As shown by FIG. 5, after passage of the steel wire 16 through the induction furnace 18, it is then passed through the apparatus 30 so as to move over the bed 32 and through a cloud of particles 34 thrown up by the bed. These particles, upon contacting the heated wire, adhere to it and coalesce to form a coating of copper. The bed is fluidized either with a flow of air upwardly from beneath the bed or, preferably and as shown by FIG. 5, by use of high frequency vibration equipment 33.

Further, and in relation to both apparatus described above, the steel wire may be preheated by a process other than by induction heating, e.g. by resistance heating and at a high frequency, i.e. at least 10 MHz, to produce a heated surface layer in the wire by "skin effect".

What is claimed is:

1. A method of making a copper clad conductor construction comprising causing copper particles to impinge upon the surface of a steel wire while causing an electrical current to flow at said surface to preferentially heat said surface to a temperature above the melting point of copper and thereby effect adhesion of the particles to the wire, building up the particles to produce a coating of copper by coalescence of the particles, and then drawing the copper coated steel wire to the required diameter.

2. A method according to claim 1 comprising causing copper particles to impinge upon the surface of the wire by spraying the particles at the wire.

3. A method according to claim 2 wherein the particles are sprayed at the wire in an airless spray.

4. A method according to claim 1 comprising causing the copper particles to impinge upon the surface of the heated steel wire by subjecting the wire to the effects of a fluidized bed of the particles which adhere to the surface of the heated steel wire.

5. A method according to claim 4 comprising vibrating the bed to fluidize it.

6. A method according to claim 4 wherein the heated steel wire is passed over the upper surface of the bed and is passed through a cloud of the particles extending up from the bed.

7. A method according to claim 1 comprising causing current to flow at said surface by electromagnetic induction.

8. A method according to claim 1 comprising causing current to flow at said surface by applying a high frequency voltage between spaced locations on the wire.

9. A method according to claim 1 wherein the particles which are caused to impinge upon the surface of the wire have substantially flat surfaces for increasing the area of contact with the wire to assist in the adhesion to the wire.

10. A method according to claim 1 comprising heating the outer layer of copper coating upon the wire to improve the smoothness of the surface finish before drawing the copper coated steel wire.

* * * * *